US012025396B2

(12) United States Patent
Albritton

(10) Patent No.: US 12,025,396 B2
(45) Date of Patent: Jul. 2, 2024

(54) AUTOMATIC LOADING REVOLVER

(71) Applicant: Evan Albritton, Birmingham, AL (US)

(72) Inventor: Evan Albritton, Birmingham, AL (US)

( * ) Notice: Subject to any disclaimer, the term of this patent is extended or adjusted under 35 U.S.C. 154(b) by 0 days.

(21) Appl. No.: 18/160,682

(22) Filed: Jan. 27, 2023

(65) Prior Publication Data

US 2023/0366645 A1 Nov. 16, 2023

Related U.S. Application Data

(60) Provisional application No. 63/303,799, filed on Jan. 27, 2022.

(51) Int. Cl.

| | |
|---|---|
| ***F41A 9/28*** | (2006.01) |
| ***F41A 9/70*** | (2006.01) |
| ***F41A 9/79*** | (2006.01) |
| ***F41C 3/14*** | (2006.01) |
| *F41A 15/02* | (2006.01) |

(52) U.S. Cl.
CPC ..... *F41A 9/28* (2013.01); *F41A 9/70* (2013.01); *F41A 9/79* (2013.01); *F41C 3/14* (2013.01); *F41A 15/02* (2013.01)

(58) Field of Classification Search
CPC ..... F41A 9/27; F41A 9/28; F41A 9/79; F41A 9/85; F41A 9/26; F41C 3/14
USPC ..... 42/59, 89
See application file for complete search history.

(56) References Cited

U.S. PATENT DOCUMENTS

| | | | | |
|---|---|---|---|---|
| 2,983,223 A * | 5/1961 | Dardick | F41A 21/12 102/434 |
| 4,325,198 A * | 4/1982 | Muck | F41A 9/85 42/89 |
| 4,468,876 A * | 9/1984 | Ghisoni | F41C 3/14 42/59 |
| 5,220,115 A * | 6/1993 | Wales | F41C 3/14 42/62 |
| 5,924,230 A * | 7/1999 | Hoke, Jr. | F41A 9/27 42/59 |

FOREIGN PATENT DOCUMENTS

WO WO-2011123076 A1 * 10/2011 ..... F41A 9/28

* cited by examiner

*Primary Examiner* — Reginald S Tillman, Jr.
(74) *Attorney, Agent, or Firm* — Dunlap Bennett & Ludwig, PLLC; Anna L. Kinney

(57) ABSTRACT

An improved revolver is disclosed. The revolver has a hollow handle and a cartridge cylinder. The revolver includes a magazine clip, releasably insertable into an interior region of the handle, and at least two cartridge sets contained within the clip. Each cartridge clip, ordinarily cylindrical in shape and unable to be inserted into the magazine clip, is easily compressed by a user into an elliptical shape, which is an improvement designed to enable quick loading, unloading, and reloading of cartridges into the magazine clip and thereafter into the cylinder of the revolver.

3 Claims, 6 Drawing Sheets

AUTOMATIC LOADING REVOLVER

REFERENCE TO RELATED APPLICATION

This nonprovisional patent application is based upon provisional U.S. Ser. No. 63/303,799, filed Jan. 27, 2022, incorporated by reference in its entirety.

FIELD

The present subject matter is directed, in general, to a revolver, and more particularly to a magazine clip and a cartridge set which are designed and configured for quickly loading, unloading, and reloading cartridges into a cylinder of a revolver.

BACKGROUND

Handguns take various forms. For instance, a pistol is a handgun, more specifically a handgun having a chamber (for cartridges) integral with its gun barrel. The English word was introduced ca. 1570, when early handguns were produced in Europe. The word "pistol" is often used to describe any type of handgun, inclusive of revolvers (having a single barrel and a separate cylinder housing multiple chambers) and the pocket-sized derringers (which are often multi-barreled). A common type of pistol in current use is the semi-automatic pistol, while nostalgic single-shot and manual repeating pistols used in bygone days, can occasionally be seen currently, but only for very special hunting excursions and historical re-enactment purposes.

A revolver is a repeating handgun having at least one barrel and including a revolving cylinder containing multiple chambers (each holding a single cartridge) for firing. Since most revolvers hold up to six rounds of cartridge (i.e., bullet) before needing to reload, revolvers are also commonly called six shooters. Before firing, cocking a revolver's hammer partially rotates the cylinder, indexing one of the cylinder chambers into alignment with the barrel, allowing the bullet to be fired through the bore. Hammer cocking in nearly all revolvers is manually driven and can be achieved by using a thumb to pull back a hammer (single-action), via internal linkage relaying force of a trigger-pull (double-action), or both (double/single-action).

By sequentially rotating through each chamber, a revolver allows a user to fire multiple times until reloading the gun, unlike prior-design single-shot firearms that needed to be reloaded after each shot. Certain rare revolver models may also use "blowback" from a preceding shot to automatically cock a hammer and index the next chamber, although such self-loading revolvers (known as "automatic revolvers," despite actually being "semi-automatic" revolvers) did not achieve widespread use.

A derringer is a small handgun that is neither a revolver nor a semi/fully automatic pistol. A derringer is not to be confused with mini-revolvers or pocket pistols. Moreover, while assorted derringers historically were manufactured with a "pepperbox" configuration, the modern derringer is often multi-barreled and is generally the smallest usable handgun of any given caliber and barrel length due to the lack of a moving action, which takes up more space behind the barrel. It is frequently used by women because it is easily concealable in a purse or a stocking.

Current revolvers have low cartridge-carrying capacity, which is a problem. Another problem is that the loading, unloading, and reloading of current revolvers is slow and cumbersome. Still another problem is that the cartridge-carrying capacity of current revolvers is less than the cartridge-carrying capacity of automatic pistols.

In the field of law enforcement and security, being able to load, unload, and reload a service revolver accurately and efficiently can be the difference between life and death. It is therefore desirable, for there to now be available a revolver having features—not found in current revolvers—where the features solve the above-noted problems, and other problems, encountered by security and law enforcement teams.

SUMMARY

The present subject matter is directed, in general, to an improved revolver having a hollow handle allowing for the insertion and removal of a magazine clip and at least two cartridge sets contained in the clip, each of which is designed for quick loading, unloading, and reloading cartridges into the cylinder of the revolver.

While the illustrated embodiment is transparent, it is to be understood that one purpose of a transparent embodiment is for enabling a detailed description of the present subject matter to be made. Other embodiments of the present subject matter can, of course, also be made from such materials as metals, composites, etc.

DETAILED DESCRIPTION

The embodiment of the automatic revolver of the present subject matter, shown in the FIGS, has a much greater cartridge-carrying capacity than conventional revolvers and is much easier to load, unload, and reload than conventional revolvers.

The revolver of the present subject matter (FIGS. 1-4) uses a unique design of cartridge sets and magazine clips to load (FIGS. 5-9), unload (FIG. 13, 15), and reload cartridges (FIGS. 17-19), for providing an improvement, over conventional revolvers.

An improved revolver 1 (FIGS. 1-4) of the present subject matter includes a revolver frame 85, a handle 120 (FIGS. 10-13) joined to the revolver frame 85, and a cylinder assembly 51 (FIGS. 1-4) rotatable about a longitudinal axis X-X relative to the frame 85. Handle 120, substantially hollow (FIGS. 1-4), thereby provides an internal region.

Figure 4:
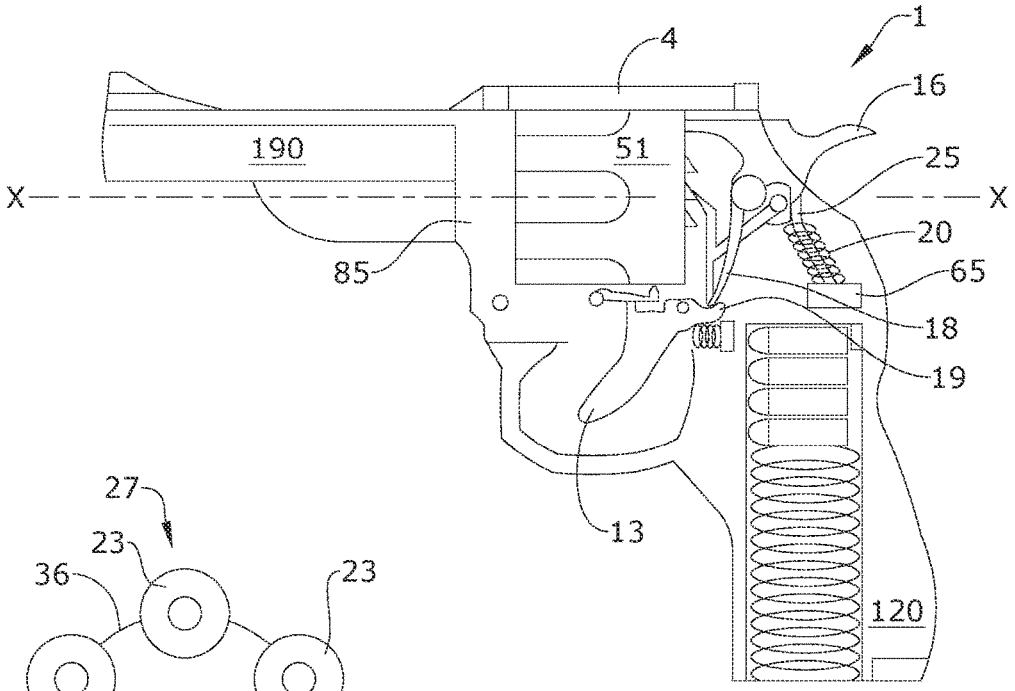
FIG. 4 is another side elevational view of the transparent revolver, with the right side portion presenting additional components of this embodiment in operation.
Figure 5:
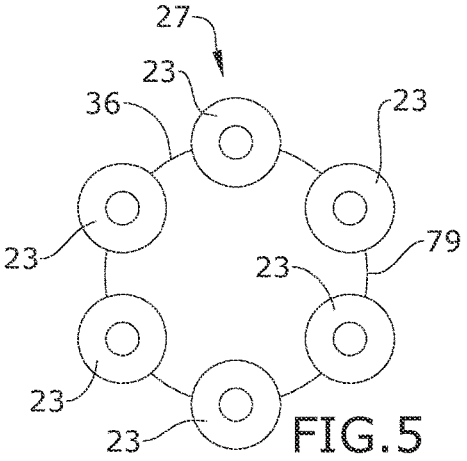
FIGS. 5 and 6 depict one component of this embodiment of the present subject matter when in a "storage" state (FIG. 6) and in an "operative" state (FIG. 5).
Figure 6:
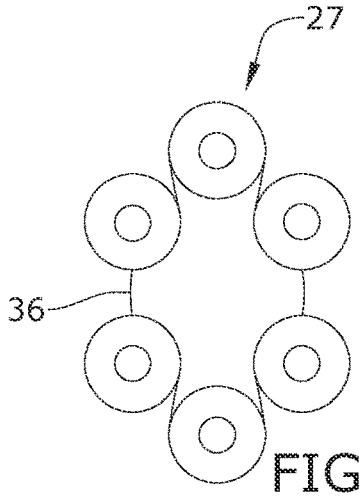

An improvement over conventional revolvers, in accordance with the present subject matter, comprises a cartridge set 27 (FIGS. 5, 6), in which the cartridge set 27 comprises a cartridge set spring 36 and coupling 79 (FIGS. 5, 6). The cartridge set spring 36 and coupling 79, further in accordance with the present subject matter, are arranged and interconnected for removably retaining cartridges 23 within the cylinder 51. The revolver cylinder 51 defines an associated plurality of cylindrical chambers 160 (FIG. 12, 13); and each chamber 160 is oriented parallel to the axis X-X (FIGS. 1-4). Each of the chambers 160 is arranged equally spaced from adjacent chambers 160 about a circle (FIG. 13); and each chamber 160 is sized and configured, for removably retaining one of the plurality of cartridges 23 (FIG. 5).

The cartridge set 27 (FIGS. 5, 6) includes an associated plurality of spring-biasing cartridge set springs 36 and couplings 79 (FIGS. 5, 6). Each of the plural cartridge set springs 36 and couplings 79 have one end portion secured to one of the plural cartridges 23 (FIG. 5, 6) and has an opposite end portion secured to an adjacent one of the plural cartridges 23. The plurality of cartridges 23 and the associated plurality of spring-biasing cartridge set springs 36 and couplings 79 form cartridge set 27, a spring-biased closed loop (FIGS. 5, 6); and the plural cartridge set springs 36 and couplings are each sized and configured for enabling the cartridge set 27 (FIGS. 5, 6) to be in a "relaxed state" and take a circular configuration (FIG. 5), to enable the associated plural cartridges 23 to be transferred into respective ones of the chambers 160. When the cartridge set 27 is in a "compressed state," it forms an elliptical configuration (FIG. 6), which allows the cartridge set 27 to flex, to enable the cartridge set 27 to be stored in the internal region of the magazine assembly 21.

Figure 10:
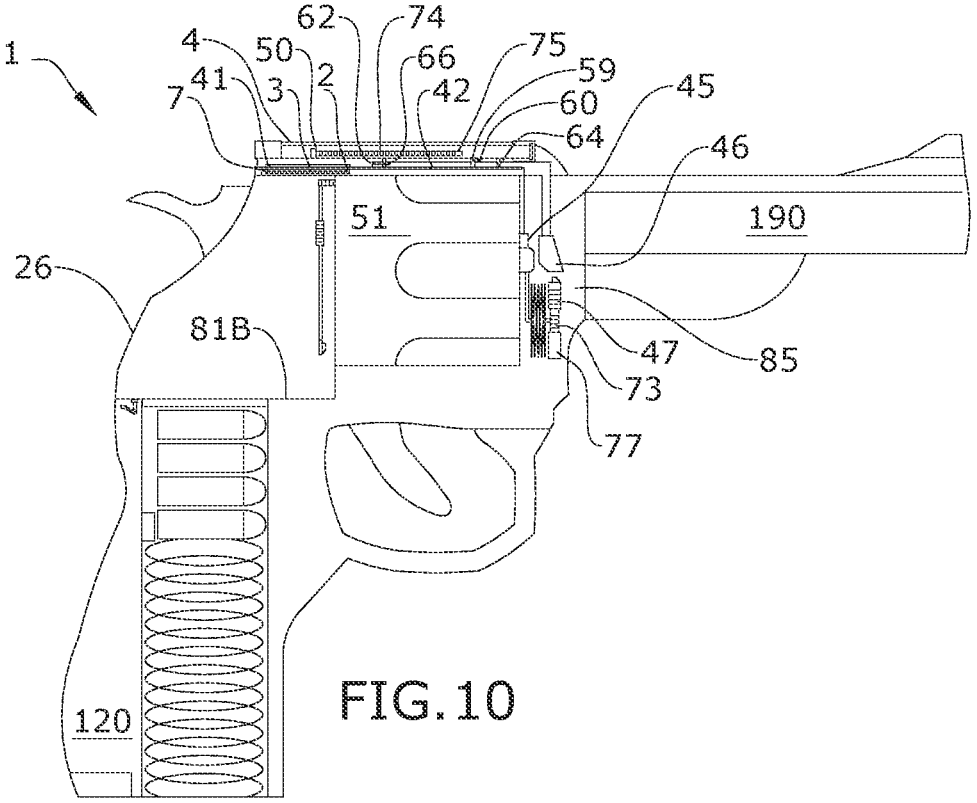
FIG. 10 is another side elevational view of the transparent revolver, in which a central revolver portion depicts additional components of this embodiment.
Figure 11:
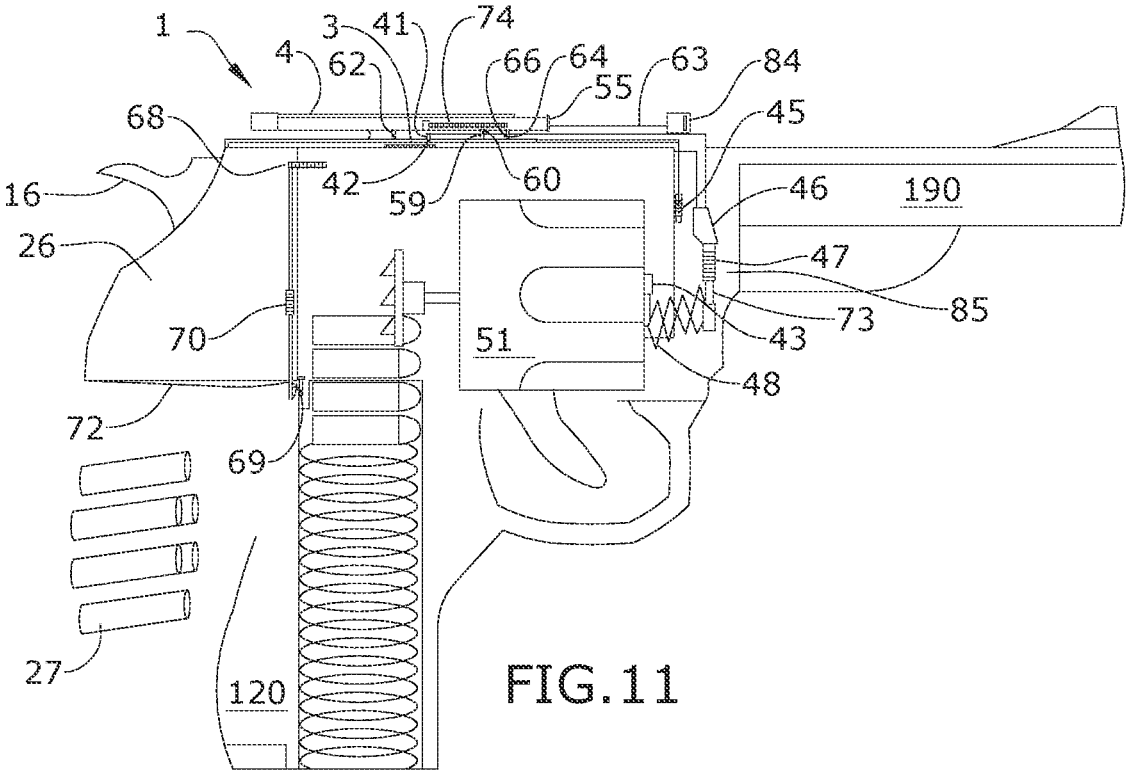
FIG. 11 is yet another side elevational view of the transparent revolver, with the central portion showing the FIG. 10 components of this embodiment in operation.
Figure 15:
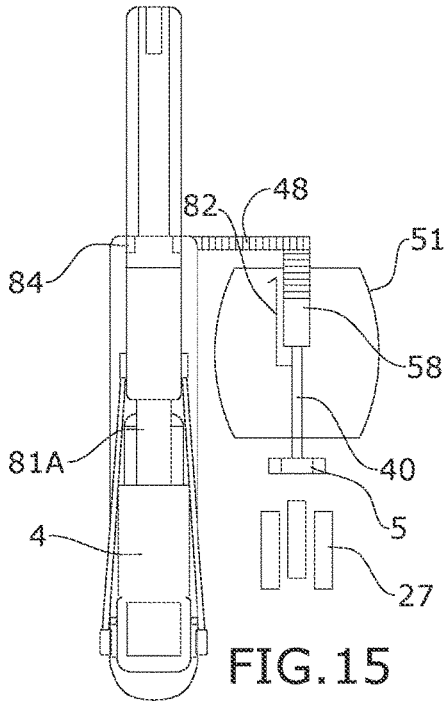

The revolver frame 85 (FIGS. 1-4) is attached to a slide stop 7 (FIG. 10) and the improved revolver 1 of the present subject matter includes a slide plunger 2 and a slide catch spring 3 (FIGS. 10 and 11). The slide catch spring 3 is attached to the slide plunger 2 and the slide stop 7 (FIG. 10). The slide stop 7 is attached to revolver frame 85 (FIGS. 10, 11). The slide plunger 2 is attached to a Revolver Control and Press (RCP) assembly 26, and RCP assembly 26 (FIG. 11) is operably attached to the revolver frame 85 (FIGS. 10, 11) by expansion slides 81*a*, 81*b* (FIGS. 10, 15).

A slide stop 50 (FIG. 10) is attached to the revolver frame 85. A cartridge set release 10 (FIG. 1), a trigger rebound spring 11 (FIG. 1), a magazine release 30 (FIG. 1), and a mortise 84 (FIGS. 11, 15) are also attached to the revolver frame 85.

Figure 1:
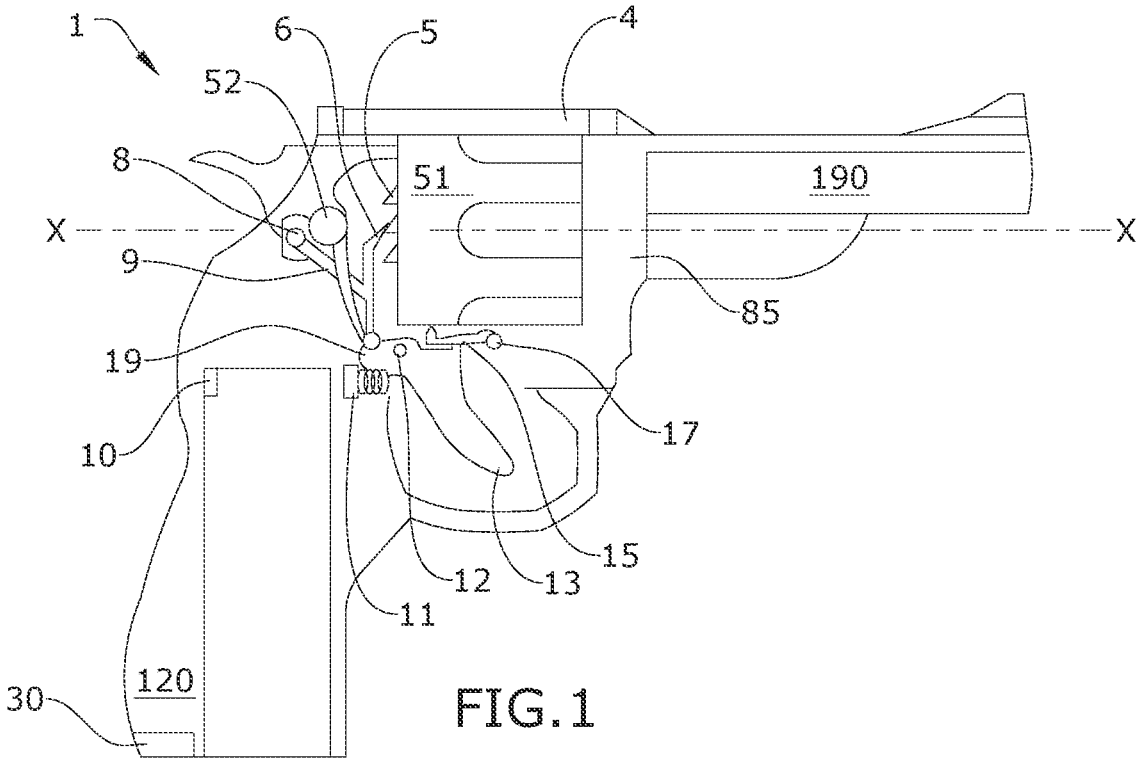
FIG. 1 is a side elevational view of a transparent revolver, in which select components of this embodiment of the present subject matter are shown on the left.

A cartridge-striking component or hammer 16 (FIG. 4) for the revolver 1 is operably attached to the revolver frame 85 by a hammer pin 52 (FIG. 1); and a trigger 13 (FIG. 1) is operably attached to the revolver frame 85 by a trigger pin 12 (FIG. 1).

Figure 14:
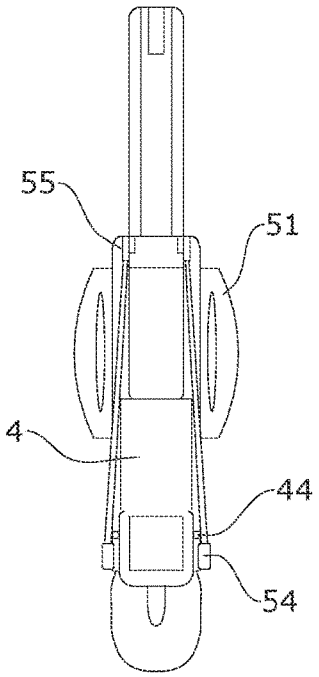
FIGS. 14, 15 depict a plan view of part of the transparent revolver, in which components of this embodiment are shown loaded (FIG. 14) and unloaded (FIG. 15).

A cylinder stop 15 (FIG. 1) is secured to the revolver frame 85 by a cylinder stop pin 17 (FIG. 1); and a slide grip 54 (FIG. 14) is connected to the slide assembly 4 by a slide release torsion spring and pin 44 (FIG. 14).

The slide assembly 4 is operably joined to revolver frame 85 by a slide groove 63 (FIG. 11); and RCP assembly 26 is operably attached to revolver frame 85 by an expansion slide 81A and 81B (FIGS. 10, 15). A slide latch 55 (FIGS. 11, 14) is also attached to the slide assembly 4. The revolver frame 85 includes hammer 16 (FIG. 4) and a trigger 13 (FIG. 1). The trigger 13, pivotably secured to the revolver frame 85 by a trigger pin 12 (FIG. 1), enables using the revolver 1 to fire cartridges 23. The trigger 13 includes an integral trigger-and-hammer lever 19 (FIG. 4). The revolver frame 85 also includes a pawl 6 and a pawl support lever 9 (FIG. 1). The pawl support lever 9 is connected to the revolver frame 85 by a pawl support pin 8 (FIG. 1). The pawl 6 (FIG. 1), unitary with the pawl support lever 9, is operatively associated with the trigger-and-hammer lever 19. The revolver frame 85 is also operably connected to a cylinder assembly 51 by scissor extension 48 (FIGS. 12-15).

A slide plunger 75 (FIG. 10) is attached to the slide assembly 4; and a slide catch spring 74 (FIGS. 10, 11) is attached to the slide plunger 75 and to the slide stop 50.

A cartridge set extractor 58 (FIG. 15) is attached to the cylinder assembly 51 (FIG. 15). An extractor catch 82 (FIG. 13) is attached to the cartridge set extractor 58. An extractor rod 40 (FIG. 15) is attached to the cartridge set extractor 58. A ratchet 5 (FIGS. 1, 15) is attached to the extractor rod 40. In operation, e.g., when "retracted" (FIGS. 12, 14), the ratchet 5 and extractor catch 82 are connected to the cylinder assembly 51; and when pushed forward by cartridge set extractor 58, the ratchet 5 and extractor catch 82 will disconnect from the cylinder assembly 51 (FIGS. 13, 15). A hammer lever 18 (FIG. 4) is operably connected to the hammer 16 by a hammer pin 52 (FIG. 1). The trigger 13 includes the trigger-and-hammer lever 19 (FIGS. 1, 4). The revolver frame 85 also includes a spring support 65 (FIG. 4). The spring support 65 supports a compression spring 20 (FIG. 4) that is operably connected to a spring plunger 25.

Figure 2:
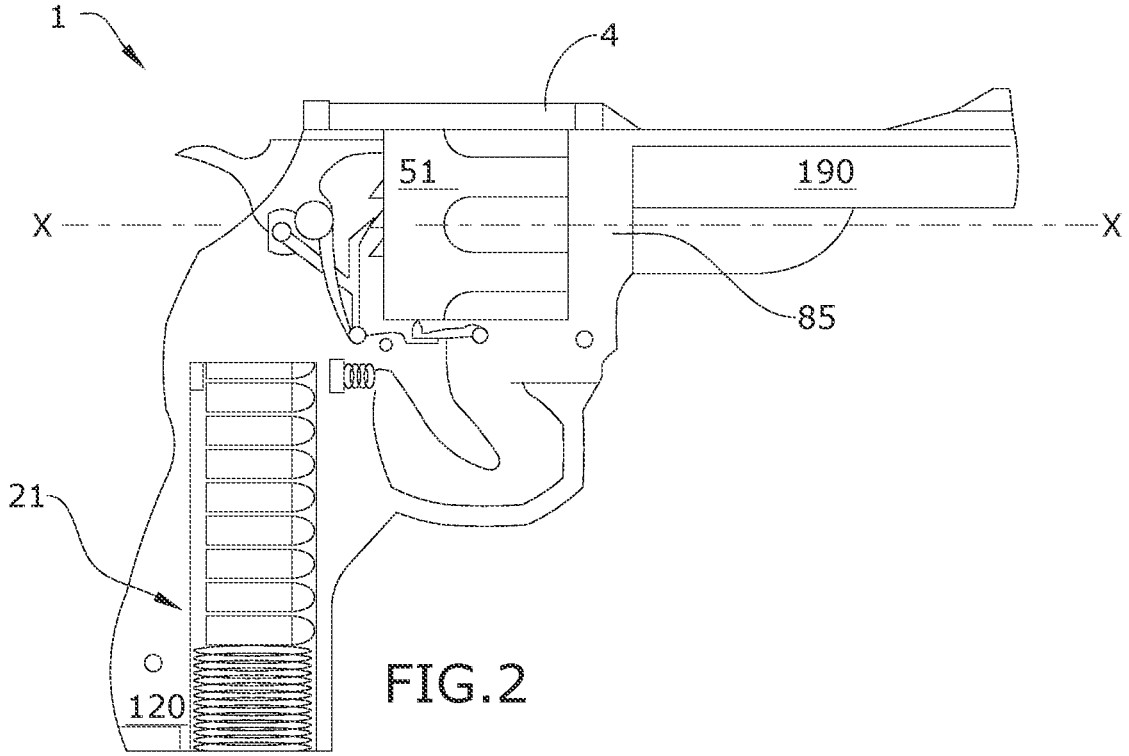
FIG. 2 is another side elevational view of the transparent revolver, with the left side portion presenting a single component of this embodiment in greater detail.
Figure 3:
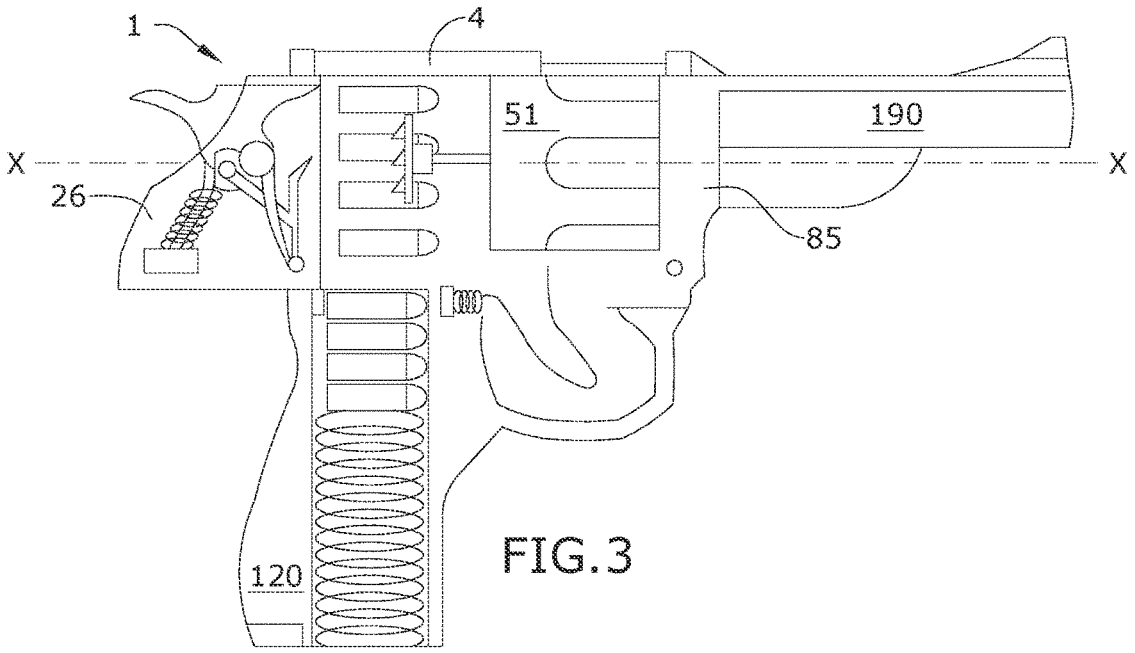
FIG. 3 depicts another side elevational view of the transparent revolver of FIGS. 1 and 2, presenting components of this embodiment in operative engagement.

The improved revolver 1 (FIGS. 1-4) of the present subject matter includes a cylinder assembly 51 (FIGS. 1, 2) oriented parallel to the longitudinal axis X-X (FIGS. 1-4). The revolver 1 also includes the hammer 16 arranged on the revolver 1 for striking a cartridge 23 contained within a chamber 160 of the revolver cylinder 51. The revolver 1 further includes the slide mechanism 4 (FIGS. 10-11 and 14-15) secured to the revolver frame 85, for enabling a user to move the Revolver Control and Press ("RCP") assembly 26 (FIG. 11) in a direction parallel to the longitudinal axis X-X (FIG. 3).

Other embodiments or variations of the improved revolver of the present subject matter are possible. For instance, a cartridge set could be loaded directly into a modified revolver without the assistance of a magazine clip. Also, the operation produced by a slide mechanism could be performed by a component that is twisted or turned, and a slide catch spring could be removed. Or a slide mechanism could manually be pushed back into its original position after being pulled back. Although select additional components could be included, while certain current components could be omitted from the revolver 1 of the present subject matter, the use of flexible cartridge sets to increase its cartridge carrying capacity and ease and reliability of loading and reloading, does not change.

The internal region of the handle 120 is sized and configured (FIG. 1, 2) to receive a magazine assembly 21

(FIGS. 2, 7-9) which includes cartridge set stops 32 (FIGS. 7, 8) within which gears 34 (FIG. 7) are embedded. The cartridge set stops 32 are attached to the magazine assembly 21 by cartridge set stop pins 78 (FIG. 8). The cogs of magazine rack gears 33 (FIG. 7) intermesh with cogs of the gears 34.

Figure 7:
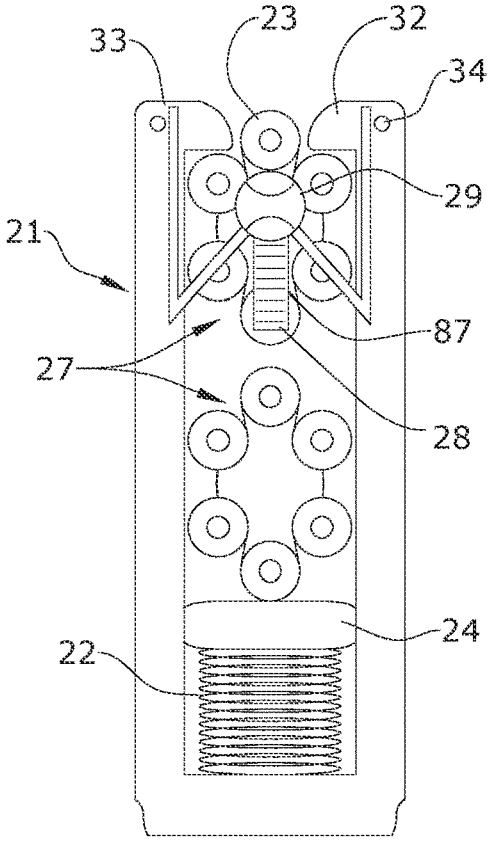
FIGS. 7, 8 depict a backside of a transparent view of a magazine clip with cartridge sets inside, in which select components of this embodiment of the present subject matter are presented.
Figure 8:
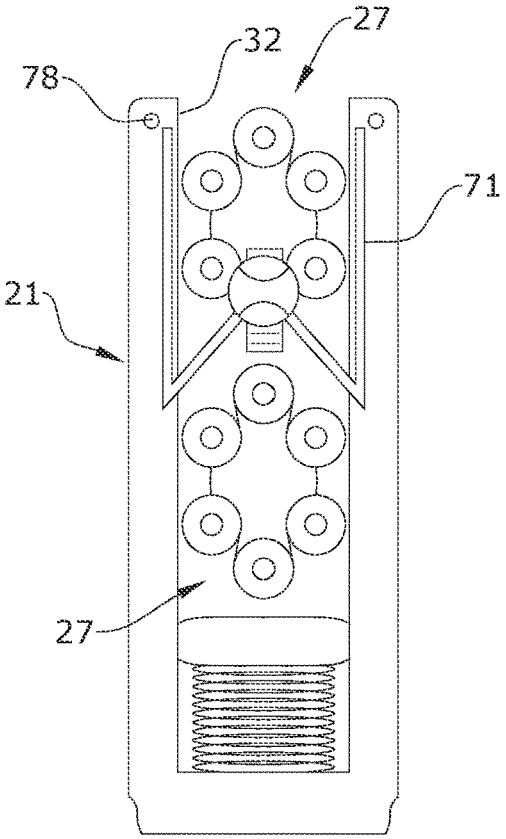
Figure 9:
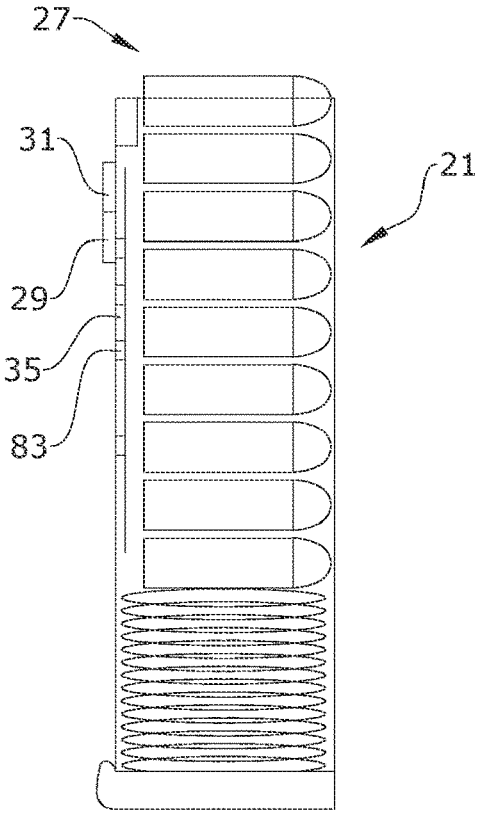
FIG. 9 is a side view of select components of the present subject matter.

The magazine assembly 21 includes a slide release 28 (FIG. 7) and a magazine spring 22 (FIG. 7). The magazine assembly 21 also includes a cartridge set release control mechanism 83 (FIG. 9) and a magazine press spring 35 (FIG. 9). The magazine assembly 21 further includes transmission bars 71 (FIG. 8) and a magazine press rod 31 (FIG. 9). A cartridge set release 29 (FIGS. 7, 9) is connected to the slide release 28 (FIG. 7). The cartridge set release 29 is also connected to the transmission bars 71 (FIG. 8), and the magazine press rod 31.

The magazine assembly 21 also includes a recoil spring 87 (FIG. 7). The transmission bars 71 are attached to the magazine rack gears 33 (FIG. 7); and the slide release 28 is connected to the recoil spring 87 and to the revolver frame 85.

Figure 17:
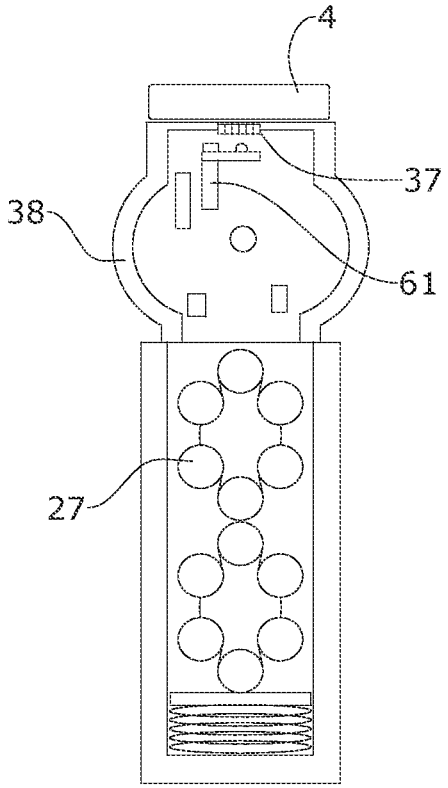
Figure 18:
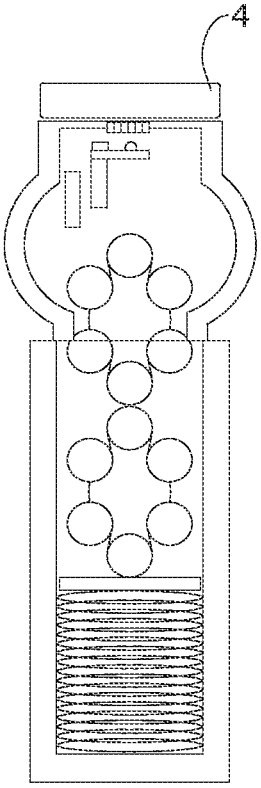

The magazine assembly 21 (FIGS. 7-9) also includes a magazine follower 24 which is attached to a magazine spring 22 (FIG. 7). The RCP assembly 26 (FIGS. 1-4) includes a cartridge set catch 38 and a catch expansion spring 37 (FIG. 17). The cartridge set catch 38 is attached to the catch expansion spring 37. The cartridge set catch 38 is also connected to the revolver frame 85 by the expansion slides 81A and 81B.

Figure 12:
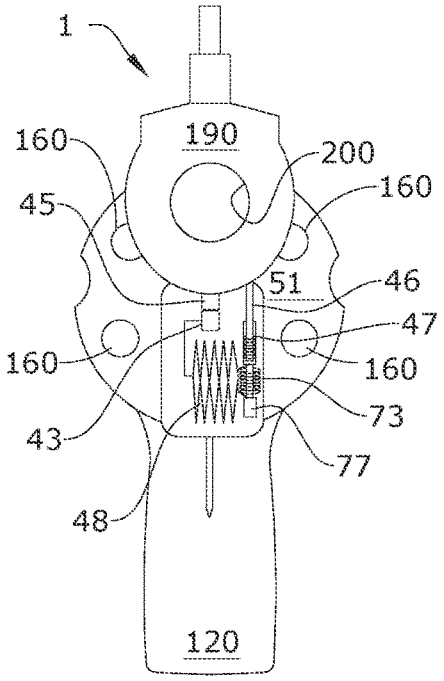
FIGS. 12, 13 show a front view of part of the transparent revolver, in which components of this embodiment are shown loaded (FIG. 12) and unloaded (FIG. 13).
Figure 13:
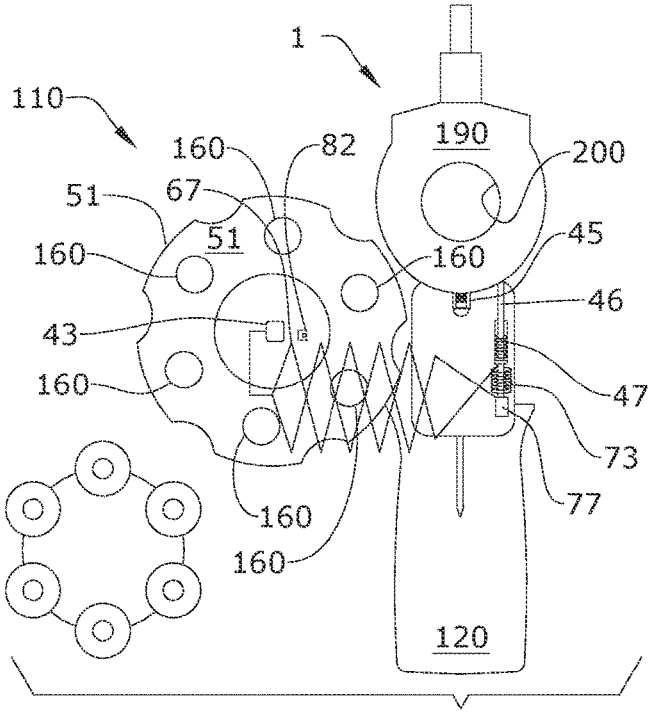

The revolver frame 85 (FIGS. 1-4, 10, 11) includes an extension press 47 (FIGS. 10-13), a rod-and-spring control 45 (FIGS. 10-13), and a scissor extension support 77 (FIGS. 10, 12, 13). A scissor extension 48 (FIGS. 11, 12, 15) is attached to the extension support 77 and the extension press 47. An extension recoil spring 73 (FIGS. 10-13) is attached to the scissor extension 48. An extractor release 67 (FIG. 13) and a connection release 43 (FIGS. 11-13) are connected to the scissor extension 48. The connection release 43 is connected to the cylinder assembly 51. A latch 41 (FIGS. 10, 11) is connected to the rod-and-spring control 45. A press latch 60 (FIGS. 10, 11), a release latch 62 (FIGS. 10, 11), and a slide press lever 64 (FIGS. 10, 11) are all connected to slide assembly 4 (FIGS. 1, 11, 14, 17).

Figure 16:
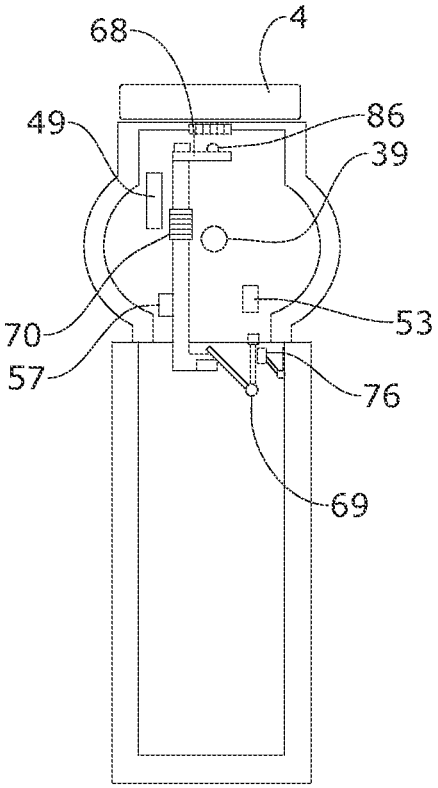
FIGS. 16-19 depict another partial frontal view of the transparent revolver, in which various components of this embodiment of the present subject matter are presented in sequential views, for enabling a detailed description to clearly be made.

An expansion slide 81B (FIG. 10) is operably connected to the RCP assembly 26 (FIGS. 3, 11) and the revolver frame 85 (FIGS. 1-4, 10, 11). The expansion slide 81A (FIG. 15) is attached to the slide assembly 4 (FIGS. 1, 11, 14, 17) and the revolver frame 85. A slide press 46 (FIGS. 10-13) is attached to the expansion slide 81A. The RCP assembly 26 (FIGS. 1-4) includes a magazine press 72 (FIG. 11), trigger and pawl lever opening 57, pawl opening 49, and cylinder mortise 39 (FIGS. 16, 17). Pawl 6 fits thru pawl opening 49 (FIG. 1, 16, 17), pawl support lever 9 fits thru trigger and pawl lever opening 57 (FIG. 1, 16, 17), and latch release 68 fits thru a latch release opening 61 (FIG. 1, 16, 17). Hammer lever 18 fits thru trigger and hammer lever opening 53 (FIGS. 4, 16, 17). A latch release opening 61 (FIG. 17), a trigger and hammer lever opening 53 (FIG. 16), and a firing pin opening 86 (FIG. 16) are part of the RCP assembly 26. An assembly mortise 42 (FIGS. 10, 11), a release lever 59 (FIGS. 10, 11), and latch release 68 (FIG. 11) are also attached to the RCP assembly 26. Attached to latch release 68 is release lever 56 and release spring 70 (FIG. 16). Assembly stop 69 and spring 76 are both attached to frame 85. A slide press lever 64 (FIGS. 10, 11) is attached to the slide press 46. An assembly mortise 42 (FIGS. 10, 11) and a release lever 59 (FIGS. 10, 11) are both attached to the RCP assembly 26. A latch release opening 61 (FIG. 17), a trigger hammer lever opening 53 (FIG. 16), and a firing pin opening 86 (FIG. 16) are part of the RCP assembly 26.

A first step for using the improved revolver 1 of the present subject matter is to insert cartridge sets 27 (FIGS. 5, 6, 17) into a magazine assembly 21 (FIGS. 2, 7-9). As noted above, a cartridge set 27 (FIGS. 5, 6) includes a plurality of spring-biasing cartridge set springs 36 and couplings 79 (FIG. 6). Each spring-biasing cartridge set spring 36 and coupling 79 has one end portion fixed to one of the cartridges 23 (FIG. 5) and an opposite end portion fixed to an adjacent cartridge 23. The plural cartridges 23 and associated fixed spring-biasing cartridge set spring 36 and coupling 79 thus form a spring-biased closed loop (FIGS. 5, 6).

Figure 19:
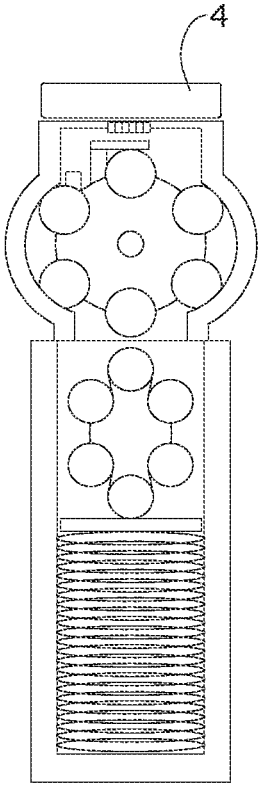

The spring-biasing cartridge set spring 36 and coupling 79 are each sized, adapted, and configured for enabling the cartridge set 27 (FIGS. 5, 6) to be in a "relaxed state" and take a circular configuration (FIG. 5), for enabling the associated plural cartridges 23 to be transferred into respective ones of the chambers 160 of the revolver cylinder 51 (FIG. 19), as needed. When the cartridge set 27 is caused by a user to be in a "compressed state," it can form an elliptical configuration (FIG. 6), which allows the cartridge set 27 to flex, to enable at least two cartridge sets 27 to be "loaded" into the internal region of a magazine assembly 21 (FIGS. 7, 8, 9). If unable to "flex," a cartridge set 27 would not fit within a magazine assembly 21. Thus, a feature of the present subject matter is that individual cartridge sets 27 can be compressed by pressing their sides together (FIGS. 17, 18), after which the sides of an individual cartridge set 27 will expand laterally outwardly to their original circular (FIG. 5) or "relaxed" state by releasing pressure exerted upon the sides (FIG. 19).

When their sides are compressed together (FIGS. 17, 18), the cartridge sets 27 will smoothly slide past cartridge set stops 32 (FIGS. 7, 8). In operation, the set stops 32 are sized, adapted, and configured to move downwardly by 90°, when pressed downwardly, which enables at least two cartridge sets 27, at a time, to be "loaded" (FIGS. 7-9) into a magazine assembly 21.

If an operator of the improved revolver 1 desires to remove a cartridge set 27 from magazine assembly 21 manually, the operator should "palm" the magazine assembly 21, and with the thumb of the same hand, push the cartridge set release 29 (FIGS. 7, 9) inwardly, and then downwardly. When the cartridge set release 29 is moved downward, the magazine rack gears 33 (FIG. 7) will also move downwardly because the rack gears 33 are attached to the cartridge set release 29 through the transmission bars 71 (FIG. 8) The gears 34 (FIG. 7) rotate when magazine rack gears 33 are moved downwardly because their cogs intermesh.

When the gears 34 rotate, the cartridge set stops 32 (FIGS. 7, 8) will rotate downwardly at a 90-degree angle because the cartridge set stops 32 are connected to the gears 34 by the cartridge set stop pins 78 (FIG. 8). In operation, the cartridge sets 27 can move freely out from the magazine assembly 21 when the cartridge set stops 32 are turned downwardly at a 90-degree angle from its original position. The cartridge set release 29 uses the slide release 28 (FIG. 7) as a guide as it is moved up and down. The magazine press rod 31 (FIG. 9), connected to the cartridge set release 29 (FIGS. 7, 9), will move inwardly and downwardly as the cartridge set release 29 is moved inwardly and downwardly. Moving the magazine press rod 31 inwardly, causes slight pushing against a cartridge set release control 83 (FIG. 9).

When a force is applied to it (i.e., the cartridge set release control 83), the cartridge set release control 83 will exert a force, in response, upon the magazine follower 24 (FIG. 7), which will slightly slow down the magazine follower 24 and prevent the magazine spring 22 (FIG. 7) from forcing a cartridge set 27 out of the magazine assembly 21 too quickly whenever it (i.e., the cartridge set 27) is manually removed from a magazine assembly 21. When an operator presses a cartridge set release 29 (FIG. 9) downward and then releases it, the recoil spring 87 (FIG. 7) will force the cartridge set release 29 (FIGS. 7, 9), the transmission bar 71 (FIG. 8), and the magazine rack gears 33 back to their original position. In addition, the gear 34 will also return to its original position because its cogs are interconnected with cogs of the rack gears 33 (FIG. 7).

The cartridge set stops 32 (FIGS. 7, 8) will also move back to their original position because they are attached to the gear 34 (FIG. 7). Once a magazine assembly 21 has had a cartridge inserted (i.e., "loaded") into it, the magazine assembly 21 should then be inserted (i.e., "loaded") into the revolver 1.

The magazine release 30 (FIG. 1) holds the magazine assembly 21 securely in the improved revolver 1 of the present subject matter. A cartridge set release 10 (FIG. 1, 2) forces cartridge set stops 32 (FIGS. 7, 8) downward at a 90-degree angle when a magazine assembly 21 is inserted into the revolver 1. When a magazine assembly 21 is inserted into revolver 1, the RCP assembly 26 (FIGS. 1, 2, 10, 11) prevents a cartridge set 27 from inadvertently moving from the magazine assembly 21 into revolver 1.

As soon as a magazine assembly 21 is inserted into the improved revolver 1, an operator should grasp and squeeze the sides of the slide grip 54 (FIG. 14), which will cause the slide latch 55 (FIGS. 11, 14) to release the mortise 84 (FIGS. 11, 15). As the sides of the slide grip 54 are being squeezed, the operator should then pull the slide grip 54 backwards. A cocking mechanism, i.e., the slide assembly 4 (FIGS. 1, 11, 14, 17), fixed to slide grip 54, will also move backwards which initiates an automatic loading process for the improved pistol 1.

The press latch 60 (FIGS. 10, 11), attached to the slide assembly 4, moves backwards when the slide assembly 4 is moved backwards. When the press latch 60 moves backwards, it will connect with the RCP assembly 26, forcing it backwards. When RCP assembly 26 is pulled backwards, pawl 6 will pull away from ratchet 5 and trigger lever 19 (FIGS. 1-3), and hammer lever 18 will also pull away from trigger lever 19 (FIG. 4). When RCP assembly 26 is moved forward and back to its original position, pawl 6 and hammer lever 18 will also move back to their original position (FIGS. 3, 4). Spring 76 will force upwards latch stop 69 (FIG. 11, 16) as RCP assembly 26 is moved backwards, which will allow latch stop 69 to temporarily lock RCP assembly 26 (FIG. 11) into place. Latch 66 (FIG. 11) is also attached to slide assembly 4 and will move backwards as slide assembly 4 is moved backwards. When slide latch 66 moves backwards, it will connect with slide latch 66 (FIG. 11) and force slide latch 66 backwards. Slide latch 66 is attached to slide press 46 (FIGS. 10, 11), which will allow slide press 46 to also move backwards as slide assembly 4 is pulled backwards; when slide press 46 is pulled backwards, it will push downward extension press 47 (FIG. 11), which will cause extension press 47 to push down the end section of Scissor extension 48. Scissor extension 48 (FIG. 11) will expand outward perpendicular to the frame of the Automatic loading revolver 1 when its end section is pressed downward. Cylinder assembly 51, connection rod 43, and extractor release 67 are all attached to scissor extension 48 (FIGS. 13, 15); cylinder assembly 51, connection rod 43, and extractor release 67 will also move outward perpendicular to the frame of the Automatic loading revolver 1 when scissor extension 48 moves outward. When extractor release 67 is extended outward, it will push against extractor catch 82 (FIG. 13), which will disconnect extractor catch 82 from cylinder assembly 51 (FIG. 15). Extractor spring 58 will push ratchet 5 outward when extractor catch 82 is disconnected from cylinder assembly 51 (FIG. 15). If there is a cartridge set 27 located within cylinder assembly 51 when ratchet 5 is pushed outward, cartridge set 27 will be discharged from cylinder assembly 51 (FIG. 15). Once RCP assembly 26 has been pulled backwards and locked into place, magazine spring 22 and magazine follower 24 will force cartridge set 27 from magazine assembly 21 into the automatic loading revolver 1 (FIGS. 2, 3, 7, 8, 11). Cartridge set 27 will connect with cartridge set catch 38 (FIGS. 17, 18, 19) when it moves from magazine assembly 21 into automatic loading revolver 1, and cartridge set springs 36 will cause cartridge set 27 (FIGS. 5, 18, 19) to expand when it moves into the automatic loading revolver 1 because there is more surface area within the automatic loading revolver 1. When forced upward into the automatic loading revolver, cartridge set 27 will push upward against latch release 68 (FIGS. 11, 16-19); when pushed upward latch release 68 will left and turn assembly stop 69 downward (FIG. 16), which will cause assembly stop 69 to release RCP assembly 26. Release spring 70 will maneuver latch release 68 downward whenever RCP assembly 26 is pulled backwards and there is no cartridge set pressing against latch release 68. RCP assembly 26 will be pushed forward by slide catch spring 3 (FIGS. 10, 11) when released from assembly stop 69, and when RCP assembly 26 is pushed forward, assembly mortise 42 will connect with latch 41 (FIGS. 10, 11) temporarily locking RCP assembly 26 into place a second time. When the cocking mechanism slide assembly 4 is pulled backwards and released, slide catch spring 74 (FIGS. 10, 11) will force slide assembly 4, press latch 60, and slide latch 66 back to their original positions. Release latch 62 (FIG. 11) is attached to slide assembly 4 and will move forward as slide assembly 4 moves forward. Release latch 62 when moving forward will connect with and push forward slide latch or slide catch 66 (FIG. 11); slide press 46 (FIG. 10, 11) is attached to slide catch 66 and will move forward when slide catch 66 moves forward. When slide press 46 moves forward, it will no longer press down extension press 47 (FIGS. 10-13), which will allow extension press 47 to stop pressing down against scissor extension 48 (FIGS. 10-13). No longer being compressed by extension press 47, extension recoil spring 73 (FIGS. 10-13) will force scissor extension 48 back into the automatic loading revolver 1. Cylinder assembly 51, connection rod 43, and extractor release 67 (FIGS. 10-13) will also move back into the automatic loading revolver 1 due to their attachment to scissor extension 48. Spring control 45 (FIGS. 12, 13) will be pushed upward when connection rod 43 moves back into the automatic loading revolver 1. When spring control 45 is pushed upward, it pushes latch 41 (FIGS. 10, 11) upward releasing the connection between latch 41 and assembly mortise 42 (FIGS. 10, 11). Slide catch spring 3 will then force RCP assembly 26 and cartridge set catch 38 (FIGS. 10, 11, 18, 19) forward back to their original position, and when pushed forward, cartridge set catch 38 (FIGS. 17-19) will expand outward and release cartridge set 27. Magazine press 72 will force downward and slide over any cartridge set remaining inside the magazine clip 21 once RCP assembly 26 has been forced forward to its original position, which helps separate the cartridge sets moving into cylinder 51 from the cartridges sets still inside magazine assembly 21. Expansion slides 81*a* and 81*b* (FIGS. 10, 15) expand outward along their length towards cylinder assembly 51. When cartridge set catch 38 moves across slides 81*a* and 81*b*, the expansion of slides 81*a* and 81*b* will cause cartridge set catch 38 to expand and release cartridge set 27 (FIG. 19). Catch expansion spring 37 (FIG. 17-19) is attached to cartridge set catch 38 and catch expansion spring 37 will cause the side of cartridge set catch 38 to retract as cartridge set catch 38 is forced backwards. When RCP assembly 26 is forced forward, it will push ratchet 5 and cartridge set 27 into cylinder assembly 51 (FIGS. 2-4). When ratchet 5 is pushed back into cylinder assembly 51, extractor catch 82 will reconnect with cylinder assembly 51, which will hold ratchet 5 and extractor and spring 58 inside cylinder assembly 51 (FIGS. 14, 15). When RCP assembly 26 is forced back into its original position pawl support lever 9 and Hammer lever 18 will reconnect with trigger and hammer lever 19 (FIGS. 1, 2, 3, 4). By simple pulling back the cocking mechanism, slide assembly 4, the Automatic loading revolver 1 has loaded six cartridges 23 into cylinder assembly 51 (FIGS. 2-4). Once all the cartridges 23 inside the automatic loading revolver 1 have been fired, the operator should repeat the process of squeezing the sides of slide grip 54 then pulling backwards and releasing slide assembly 4; the process of self-loading will repeat itself. The first cartridge set 27 will be ejected from cylinder assembly 51 by extractor and spring 58, and the second cartridge set 27 will be moved from magazine assembly 21 into cylinder assembly 51 (FIGS. 10, 11). The entire process takes less than two seconds.

Suitable materials (e.g., metals, composites, polymeric materials) may be formed (e.g., cast, molded, 3-D printed) to proper shape, size, and tolerance values, for producing components described in this patent specification, necessary to produce an improved revolver 1 of the present subject matter. After all necessary components are formed, various pins and bolts of suitable size and shape can be used to assemble the components described in this specification into an improved revolver of the present subject matter. Once assembled, the improved revolver should be tested and calibrated, to be operational at predetermined specifications.

While components of the automatic revolver 1 of the present subject matter may be interchanged or re-configured to increase efficiency or performance values using modified or different components, an aspect or feature of the present subject matter is its use of flexible cartridge sets to increase its cartridge carrying capacity, as well as the ease and reliability of loading and re-loading the automatic revolver.

An operator would first insert cartridge set 27 into magazine assembly 21, which takes about two seconds. The operator would then insert magazine assembly 21 into the improved revolver 1. The operator should then cock slide mechanism 4 by squeezing the sides of slide grip 54, then pulling slide 4 backwards and then releasing it. Now within three seconds the revolver 1 is fully loaded and ready to be fired. If the operator wants to remove the cartridge set 27 inside cylinder assembly 51, the operator should cock slide mechanism 4 a second time, which will cause the first cartridge set 27 to be ejected from cylinder assembly 51 and at the same time allow a second cartridge set 27 to move from magazine assembly 21 and into cylinder assembly 51. When the second cartridge set 27 is loaded into cylinder assembly 51, the automatic loading revolver 1 is ready to be fired again. The unloading of the first cartridge set 27 and loading of the second cartridge set 27 should take less than one second.

What has been illustrated and described in this patent specification is an improved automatic revolver. While the present subject matter has been described with reference to an exemplary embodiment, the present subject matter is not limited to the illustrated embodiment. On the contrary, many alternatives, changes, and/or modifications will become apparent to a person of ordinary skill in the art ("POSITA") after this specification and its FIGS. have been reviewed. Therefore, all alternatives, changes, and/or modifications are to be treated as forming a part of the present subject matter insofar as they fall within the spirit and scope of the appended claims.

I claim:

1. In a revolver (1) having a main body frame (85), a handle (120) joined to the frame (85), and a cylinder (51) rotatable about an axis X-X relative to the frame (85), wherein the handle (120) is hollow and defines an internal region, wherein the improvement comprises: a cartridge set comprising: a spring-biased assembly comprising: a plurality of springs (36) and couplings (79) forming a spring-biased closed loop, dimensioned and configured to retain an associated plurality of cartridges, wherein the cylinder (51) defines an associated plurality of cylindrical chambers, wherein each chamber is oriented parallel to the axis and arranged equally spaced from adjacent chambers about a circle, wherein each chamber is sized and configured to removably retain an associated one of the plurality of cartridges, wherein each of the plurality springs has one end portion secured within the spring-biased closed loop and has an opposite end portion secured to an opposing side within the spring-biased closed loop, wherein the plurality springs are sized and configured for enabling the spring-biased loop to relax to form a circular configuration for enabling the associated plurality of cartridges to be transferred into each associated one of the plural chambers and to flex to form an elliptical configuration when disposed in the internal region.

2. The revolver of claim 1, wherein the spring-biased assembly has at least two springs (36) and two couplings (79).

3. The revolver of claim 1, further including a magazine assembly having an exterior surface dimensioned and configured to be releasably insertable into the interior region of the handle, and wherein the magazine assembly defines an interior region dimensioned and configured to contain at least two cartridge sets.

* * * * *